United States Patent [19]

Rogers, Jr. et al.

[11] 4,188,062

[45] Feb. 12, 1980

[54] HANDLE-OPERATED WALL-AVOIDING RECLINER CHAIR WITH HEADREST

[75] Inventors: Walter C. Rogers, Jr., Denton; David S. Hoffman, High Point, both of N.C.

[73] Assignee: Royal Development Company, Inc., High Point, N.C.

[21] Appl. No.: 923,389

[22] Filed: Jul. 10, 1978

[51] Int. Cl.[2] ..... A47C 1/037; A47C 7/36

[52] U.S. Cl. ..... 297/61; 297/85; 297/403

[58] Field of Search ..... 297/61, 68, 85, 112, 297/114, 403, 408, 409

[56] References Cited

U.S. PATENT DOCUMENTS

| | | | |
|---|---|---|---|
| 3,850,475 | 11/1974 | Katz et al. | 297/85 |
| 3,865,432 | 2/1975 | Rogers, Jr. et al. | 297/61 X |
| 3,871,705 | 3/1975 | Harrison | 297/61 |
| 3,942,835 | 3/1976 | Harrison | 297/61 |
| 3,958,827 | 5/1976 | Ré | 297/61 |
| 4,071,275 | 1/1978 | Rogers, Jr. | 297/85 |
| 4,108,491 | 8/1978 | Rogers, Jr. | 297/85 |

*Primary Examiner*—William E. Lyddane

*Attorney, Agent, or Firm*—William E. Mouzavires

[57] ABSTRACT

A handle-operated, wall-avoiding, recliner chair having a headrest which during normal or upright position of the chair is concealed behind the backrest but which is extended upon movement of the chair to TV position or to reclining positions to support the head and upper regions of the back of the chair occupant. The chair is moved into TV position, that is, with the footrest extended, by means of a handle mounted on the side of the chair. The headrest is mounted to the backrest by a linkage which is actuated to extend or retract the headrest by means of a headrest actuating linkage connected to the handle to be driven thereby when the chair is moved to the TV position. The headrest mounting linkage is also actuated when the chair is moved to advanced reclining positions, beyond TV position, to further position the headrest in harmony with the advanced reclining position of the chair.

2 Claims, 3 Drawing Figures

HANDLE-OPERATED WALL-AVOIDING RECLINER CHAIR WITH HEADREST

OBJECTS OF INVENTION

The present invention generally relates to wall-avoiding recliner chairs, that is, reclining chairs that may be placed adjacent a wall and moved into reclining positions without the backrest striking the wall. Such recliner chairs have now become quite popular in use today.

The present invention more specifically relates to such a wall-avoiding recliner chair having a headrest (sometimes also referred to as a secondary backrest). In industry such a recliner is also sometimes referred to as a "pop-up" recliner because upon placement of the chair into a reclining position, the headrest is projected upwardly above the backrest from a position concealed behind the backrest to support the head and upper regions of the back of the chair occupant.

An object of the present invention is to provide a novel wall-avoiding reclining chair having a headrest in addition to a backrest which headrest is operated to an extended position when the chair is moved into a TV position, that is, with its footrest extended. Included herein is the provision of such a recliner chair whose footrest is extended through means of a manually operable handle which, moreover, is utilized to operate the headrest simultaneously with the footrest.

Another object of the present invention is to provide a novel headrest actuating mechanism which may be utilized in conventional recliner chairs to permit an associated headrest to be operated simultaneously with movement of a footrest to the extended position, the latter being achieved through means of an operating handle positioned on one side of the chair.

SUMMARY OF INVENTION

In one particular form, the present invention may be incorporated into a three-way wall-avoiding recliner chair, such as shown and described in U.S. patent application Ser. No. 789,958, entitled "Wall-Avoiding Recliner Chair", filed Apr. 18, 1978 and assigned to the assignee of the present application and now U.S. Pat. No. 4,108,491. The disclosure of the aforementioned application is hereby incorporated by reference into the subject application. Such a chair includes a handle-operated actuating means for driving the footrest between extended and retracted positions thereof. In accordance with the present invention, a headrest is mounted by means of a headrest mounting linkage to the backrest to be movable between a normal concealed position behind the backrest and an extended position projected upwardly from the backrest. The headrest mounting linkage is actuated to move the headrest between the aforementioned positions by means of a headrest actuating linkage connected between the headrest mounting linkage and the handle-operated actuating means. In the preferred embodiment, the headrest actuating linkage includes three links, the first being connected to the handle-operated actuating means of the footrest, the second link being connected to the first link while also being mounted intermediate its ends to a backrest linkage utilized to mount the backrest; and the third link being connected at one end to the second link and at the opposite end to the headrest mounting linkage. Also, in the preferred embodiment, the headrest mounting linkage consists of a pair of links both having their opposite ends pivotally connected to the backrest and the headrest.

DRAWINGS

Other objects and advantages of the present invention will become apparent from the following more detailed description taken in conjunction with the attached drawings in which.

DETAILED DESCRIPTION

Figure 1:
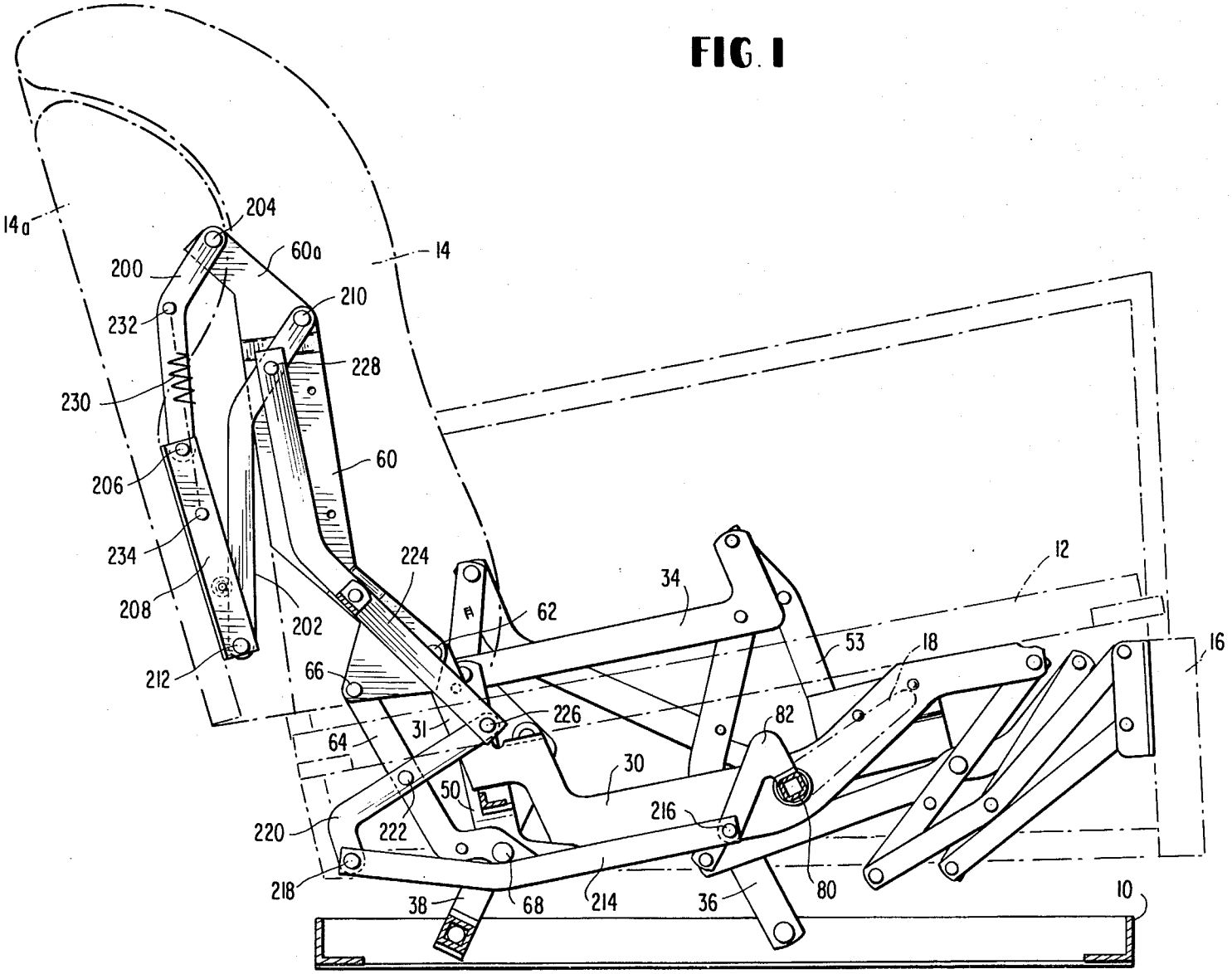
FIG. 1 is a side elevational view of a recliner chair embodying the present invention, shown in the normal or upright position, and with portions of the chair framing shown in phantom lines.

Referring now to the drawings in detail, there is shown for illustrative purposes only, a three-way wall-avoiding, recliner chair of the type shown in co-pending U.S. patent application Ser. No. 789,958 which is assigned to the same assignee of the present application and whose disclosure has been incorporated by reference into the present disclosure. Such a chair includes primary support structure in the form of a base 10, a seat 12 movable relative to the base into various reclined positions, a backrest 14 movable relative to the seat and the base between normal and various reclining positions; and a footrest 16 movable between a retracted position adjacent the front of the chair and an extended position projected forwardly from the front of the chair. Footrest 16 is operated through an actuating mechanism including a drive shaft 80, a crank 82 affixed to the drive shaft and connected to a footrest linkage system. The footrest actuating mechanism is operated through means of a handle 18 which is fixed to drive shaft 80 to rotate the same about its horizontal axis.

Seat 12 is affixed to a seat link 30 which is suspended from a carrier link 34 by means of front and rear suspension links 50 and 53; the links 30, 34, 50 and 53 comprise what may be referred to as a "seat linkage". The seat linkage is mounted for movement relative to base 10 by means of a mounting linkage which includes a front mounting link 36 and a rear mounting link 38.

Backrest 14 includes a backrest link 60, **60*a* affixed to the backrest, and pivotally mounted to portion 31 of seat link 30 and an actuator link 64 which, in turn, is pivotally connected at pivot 68 to rear mounting link 50 to drive the same into advance reclining positions beyond TV position. Links 60, 60*a*, and 64** may also be termed a "backrest linkage".

A more detailed description of the structure and operation of the various links and linkage systems described thus far may be obtained from the aforeidentified co-pending U.S. application Ser. No. 789,958, and thus no further review herein is deemed to be necessary.

In accordance with the present invention, the chair is provided with a headrest generally designated **14*a* which may also be termed a "secondary backrest" or a "pop-up" headrest. Headrest 14*a* is mounted to the main backrest 14 by means of what will be termed herein a "headrest mounting linkage". In the preferred embodiment shown, the headrest mounting linkage includes a pair of links 200 and 202, the opposite ends of each of which are pivotally connected to backrest 14 and backrest 14*a*. In the specific form shown, headrest mounting link 200 has one end pivotally connected by pivot 204 to the upper end 60***a* of backrest link 60 and an opposite end pivotally connected by pivot 206 to a fixed bracket link 208 which is fixed to the headrest 14*a*. The other headrest mounting link 202 has one end pivoted by pivot 210 to backrest link 60*a* and its opposite end pivoted by pivot 212 to bracket link 208. It will be seen that the headrest mounting links 200 and 202, together with portions of the backrest link 60*a* and bracket link 208 define a four-bar linkage. In moving between the retracted position shown in FIG. 1 and the extended position shown in FIG. 2, the headrest mounting links pivot about pivots 204, 210 relative to backrest 14.

It is of course, necessary or highly desirable that the headrest be projected to its extended position when the chair is reclined with footrest 16 projected to its extended position, the latter position being known in the trade as TV position. Further, in accordance with the present invention, a headrest actuating linkage is provided to achieve the foregoing objective. In the preferred embodiment of the invention shown, the headrest actuating linkage includes three links, the first being link 214 having one end pivotally connected by pivot 216 to crank 82 as shown in FIG. 1. The opposite end of link 214 is pivotally connected by pin 218 to a second headrest actuating link 220 which is mounted intermediate its ends by pivot 222 to one of the backrest mounting links, shown as link 64. The other end of link 220 is pivotally connected by pivot 226 to a third headrest actuating link 224 which is pivotally connected by pivot 228 to one of the headrest mounting links, preferably link 202.

In the closed or normal position of the chair, the position of the headrest actuating linkage is shown in FIG. 1. It will be seen that when handle 18 is moved to place the chair into TV position with the footrest extended as shown in FIG. 2, the footrest actuating mechanism, including crank 82 will serve to move headrest actuating link 214 forwardly of the chair which, in turn, will serve to pivot link 220 about pivot 222 in a counterclockwise direction which, in turn, will serve to raise link 224 which, in turn, will open the headrest mounting linkage to first move the headrest rearwardly of the chair and then upwardly of the backrest into the desired extended position shown in FIG. 2.

In order to help keep the headrest 14*a* in its extended position, a biasing mechanism, if desired, may be provided. In the preferred embodiment, such a biasing mechanism includes a tension spring 230, one end of which may be fixed at lug 234 on bracket link 208 and the other fixed by rivet 232 to an intermediate portion of headrest mounting link 200.

Figure 2:
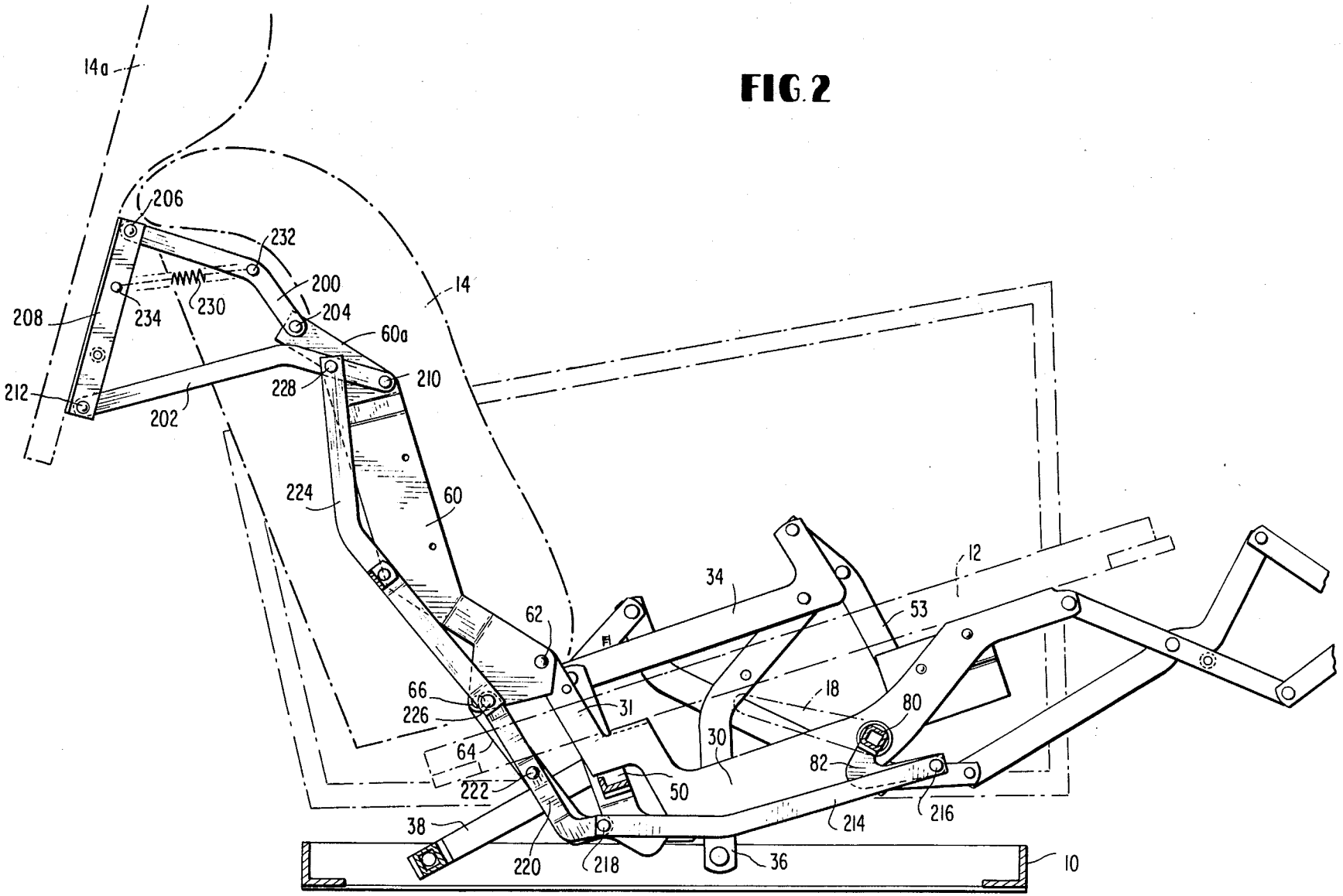
FIG. 2 is a view similar to FIG. 1 but with the chair shown in TV position.
Figure 3:
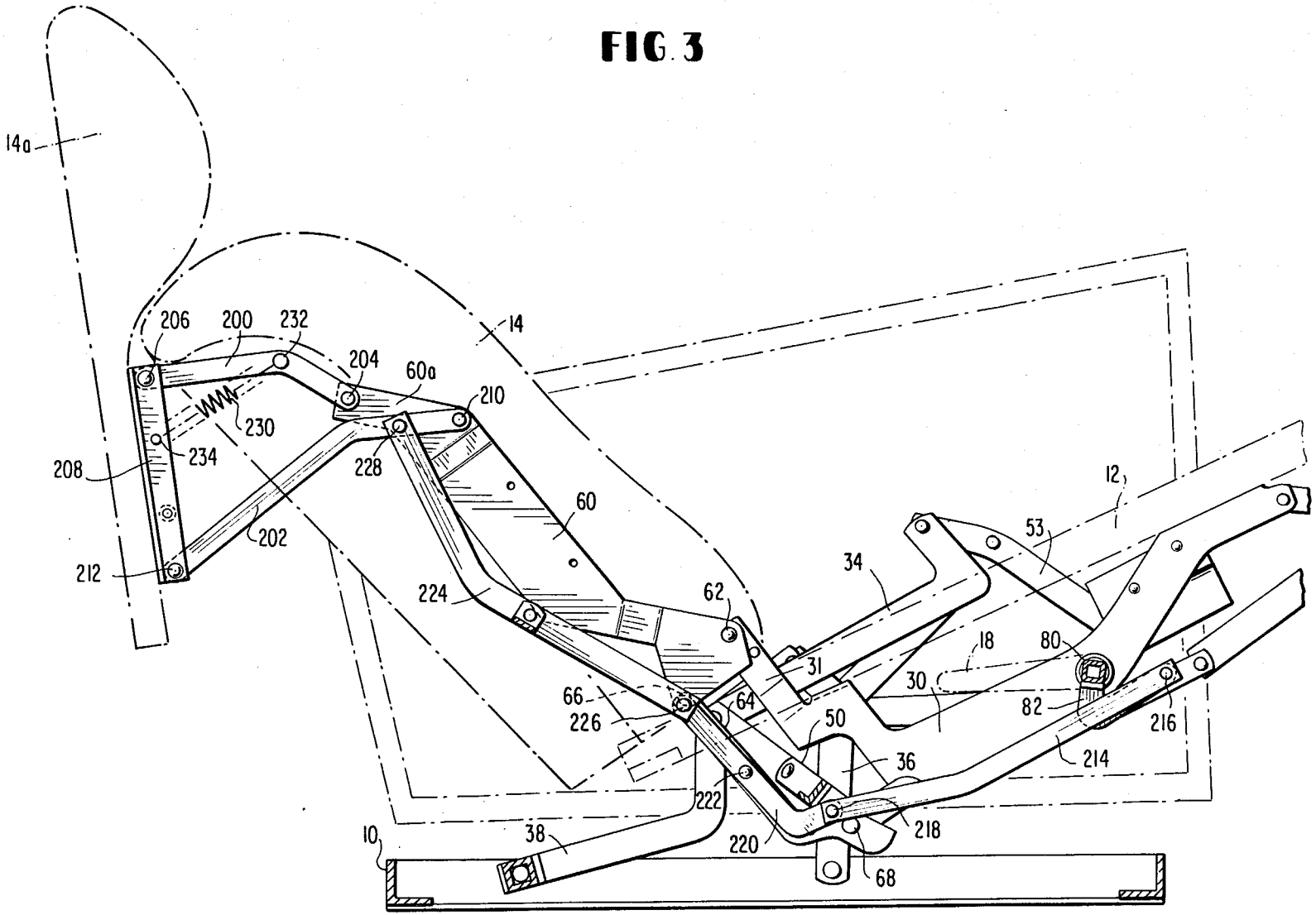
FIG. 3 is a view similar to FIG. 2 but with the chair shown in the full reclining position.

While the chair is in the TV position shown in FIG. 2, if it is desired to move to a further reclined position, the occupant need only exert back pressure on the backrest 14 which will cause the backrest to pivot about pivot 62 which, in turn, will drive the backrest mounting link 64 downwardly which, in turn, will actuate the seat linkage, as described in co-pending U.S. application Ser. No. 789,958. During this latter movement, the headrest 14*a* will be moved a slight amount (in the counterclockwise direction) relative to the backrest 14 to slightly increase the angle between the headrest and backrest. The fully reclined position of the chair is shown in FIG. 3.

It will thus be seen that the present invention permits a handle-operated, wall-avoiding, recliner chair to be provided with a headrest or secondary backrest which may be extended simultaneously with movement of the footrest to the extended position and which will not strike an adjacent wall assuming, of course, that the chair is placed adjacent a wall.

In the claims to follow, numerals referring to the preferred embodiment shown and described above have been used to help the reader's understanding; however, the claims are not limited to the specific embodiment shown but rather, encompass all variations thereof as will be readily apparent to those skilled in the pertinent art.

What is claimed is:

1. In a wall-avoiding recliner chair including a primary support structure, a seat and backrest mounted relative to the primary support structure for movement between normal and reclining positions with the seat and backrest being movable forwardly relative to the primary support structure when moving to reclining position, a backrest linkage mounting the backrest for movement relative to the seat, a footrest movable between an extended position projected forwardly from the chair and a retracted position adjacent the front of the chair, and a handle-operated actuating means for driving the footrest between the extended and retracted positions thereof; a headrest (14*a*), a headrest mounting linkage (200, 202) mounting the headrest to the backrest for movement between a normal position behind the backrest and an extended position projected above the backrest, and a headrest actuating linkage (214, 220, 224) connected to said handle-operated actuating means for moving the headrest to the extended position when the footrest is moved to the extended position, said headrest actuating linkage includes a first link (214) extending in the generally forward-rearward direction of the chair and having a forward end portion connected to said handle-operated actuating means to be driven generally longitudinally thereof, a second link (220) pivotally mounted intermediate its ends relative to said backrest linkage, said second link having one end portion pivotally connected to a rear end portion of said first link and having an opposite end portion, and a third link (224) extending in a generally vertical direction and having a lower end portion pivotally connected to said opposite end portion of said second link (220) and an upper end portion pivotally connected to said headrest mounting linkage for driving the same between said normal and extended positions in response to said handle-operated actuating means.

2. The chair defined in claim 1 wherein said headrest mounting linkage includes a pair of links (200, 202), both having opposite end portions pivotally connected to the backrest and the headrest, and wherein said third link (224) is pivotally connected to one of said pair of links (200, 202) intermediate the ends thereof.

* * * * *